US010010123B2

(12) United States Patent
Dwars

(10) Patent No.: US 10,010,123 B2
(45) Date of Patent: Jul. 3, 2018

(54) HAND GRIP SPORT STRAP

(71) Applicant: Rex Ronald Dwars, Cedar Rapids, IA (US)

(72) Inventor: Rex Ronald Dwars, Cedar Rapids, IA (US)

( * ) Notice: Subject to any disclaimer, the term of this patent is extended or adjusted under 35 U.S.C. 154(b) by 164 days.

(21) Appl. No.: 15/000,511

(22) Filed: Jan. 19, 2016

(65) Prior Publication Data

US 2017/0202282 A1 Jul. 20, 2017

(51) Int. Cl.
*A41D 13/08* (2006.01)

(52) U.S. Cl.
CPC ..... *A41D 13/081* (2013.01); *A41D 2400/80* (2013.01)

(58) Field of Classification Search
CPC ..... A63B 21/4021; A63B 21/4019
USPC ..... 482/139; D21/662
See application file for complete search history.

(56) References Cited

U.S. PATENT DOCUMENTS 4,487,412 A * 12/1984 Meeko ..... A63B 21/4021 482/106
4,936,571 A * 6/1990 Buhr ..... A63B 21/4021 482/105
5,704,883 A * 1/1998 Eckmann ..... A63B 21/065 482/105
5,746,685 A * 5/1998 Glaser ..... A63B 21/4019 2/161.1
5,888,180 A * 3/1999 Dewberry ..... A63B 21/4019 2/161.1
D525,323 S * 7/2006 Dwars ..... D21/662
9,265,985 B2 * 2/2016 Uygan ..... A63B 21/4035
2016/0023037 A1 * 1/2016 Schiek ..... A63B 21/0783 482/92

* cited by examiner

*Primary Examiner* — Joshua T Kennedy

(57) ABSTRACT

A hand gripping sport strap used to grip a bar or handle. One piece of strap material with two ends. Each end has two sides. The two ends are overlapped, forming a perpendicular right angle with each end placed in line with one side of the other end and secured. A 90° angle tip is formed with both ends and two sides of strap material. This tip made with two layers of strap material is now cut off making an adjustment area. The inside and outside of this adjustment area is then covered with a high-wear resistant and non-slip material, now referred to as the V area when completed. A loop of strap material created by bringing the two ends together will go on the back of the hand with the V area positioned in the palm of the hand after the hand and all five fingers are put through the loop of the strap material.

6 Claims, 12 Drawing Sheets

HAND GRIP SPORT STRAP

RELATED APPLICATIONS

See U.S. Design Pat. No. D525,323S filed Aug. 7, 2002. Date of patent Jul. 18, 2006.

BACKGROUND OF THE INVENTION

1. Field of the Invention

The invention relates to the field of using one or both of the users hands and fingers to improve the users grip during sport or other related events. These events include weight lifting, strength training, baseball, golf, tennis or any other event that enables a person to increase grip strength.

2. Description of Related Art

All weight lifting straps or hand gripping devices aid the user in gripping and holding on to the object being used. The items being gripped could be a weight lifting bar, baseball bat handle, golf club handle, tennis racket handle or other similar applications. All weight lifting straps or gripping devices reduce the fatigue in the hand and arm areas to some degree more or less.

This hand gripping sport strap is better because in use the strap material only comes in contact with the back of the hand about 180° just below the metacarpal joint (wrist joint) towards the users knuckles. In all other designs the strap material and padding goes 360° around the wrist joint and must be tightly secured. This can cause discomfort in the wrist area and other use issues.

The "V" area, of this hand gripping sport strap, where the two ends of the strap material are joined together at a specific angle and sewn together is the key to this invention. Also, the other aspects that make-up this "V" area are what makes this invention different than all others.

The user will be able to position the "V" area very easily with the same hand onto any bar or handle and then adjust tightness, looseness, overall comfort and control with wrist and hand support.

The material covering the strap material in the "V" area provides a durable wear surface with just enough slip so the hand and fingers can make any adjustment needed before or during the event using this invention.

At anytime the user can simply open up the fingers of either hand being used and release the object being grabbed.

SUMMARY OF THE INVENTION

It is an aspect of the invention to provide a hand grip sport strap that will help the user gain strength and control with the wrist, hand and finger support during weight training or other sport activities needing better hand grip and wrist support.

It is another aspect of the invention to provide a hand grip sport strap that fits loosely around the back of the hand below wrist joint (metacarpal joint) when not in use.

It is an aspect of the invention to provide a hand grip sport strap that, when in use, the strap material only comes in contact with the back of the hand, about 180°, just below the metacarpal joint (wrist joint).

It is an aspect of the invention to provide a hand grip sport strap that one size does not fit all users, male or female.

It is an aspect of the invention to provide a hand grip sport strap where there are at least five sizes that fit 100% of women and 100% of men while gripping a weightlifting bar, baseball bat handle, or other object up to about 2" in diameter.

It is an aspect of the invention to provide a hand grip sport strap that these sizes will be referred to as small, medium, large, x-large and xx-large. All sizes are determined by measuring 360 around the wrist joint (metacarpal joint) very accurately.

It is an aspect of this invention to provide a hand grip sport strap that the user, using his or her thumb on either hand and placing the tip of that thumb into the "V" area, will allow that user to grab any round or oval shaped weight lifting bars, baseball bat handles, golf and tennis handles that are up to about 2" in diameter at anytime. During weight lifting, the user will be able to grab any bar or handle below the knees or above the head.

It is an aspect of the invention to provide a hand grip sport strap that there is only one correct way to put this invention on your hand. By sliding your entire hand, all five fingers, through the strap loop of the grip furthest away from the "V" area. The "V" area has a natural curve because of the way the two ends of the strap material are sewn together. The curve should be pointed toward the palm of the hand.

It is an aspect of this invention to provide a hand grip sport strap, that when you want to grab a weight lifting bar, for example, with one hand over your head, the user can use the thumb on that same hand and place the tip of that thumb in the "V" area of the strap. Once the "V" area, using the thumb, has been placed in contact with the bar and in the correct position, a small amount of pressure should be placed with one or more of the other four fingers on that same hand to the "V" area and then bring the thumb from the "V" area back out of the that "V" area so that all five fingers are again through the top loop of the grip. Now that all five fingers are again through the top loop of the strap, adjust the strap as needed.

It is an aspect of this invention to provide a hand grip sport strap that if the user is doing an exercise that only uses one hand there is another way to get your hand and grip not only into the correct position but also with the correct adjustment. Simply use your thumb of your other hand and push the "V" area into and around the gripping area or bar of the equipment being used.

It is an aspect of the invention to provide a hand grip sport strap that will not fall off your hand when not in use.

It is an aspect of this invention to provide a hand grip sport strap that when the user wants to use the invention all that the user has to do is point the hand and fingers down to the ground and shake the hand or touch the strap to the hip of the user and then make final adjustment of the "V" area with the users fingers of the hand.

It is an aspect of this invention to provide a hand grip sport strap that the material used in the "V" area that comes in contact with the hand and the object being grabbed, is made with a very durable material that has non-slip properties depending on the pressure of the hand and fingers of the user.

It is an aspect of this invention to provide a hand grip sport strap that the "V" area has many gripping edges that allow the users fingers to make any adjustments of the invention as needed for tightness, looseness and overall comfort and control.

It is an aspect of this invention to provide a hand grip sport strap that can be used for both pushing and pulling exercises. The "V" area for pushing exercises can be placed into the contour and shape of the inside of the users hand and fingers.

It is an aspect of this invention to provide a hand grip sport strap that can be inexpensive to manufacture because of its simple design.

It is an aspect of this invention to provide a hand grip sport strap that the object being grabbed can be easily released from the users hand by opening the hand and fingers of the hand.

DRAWING REFERENCE NUMERALS

Figure 1:
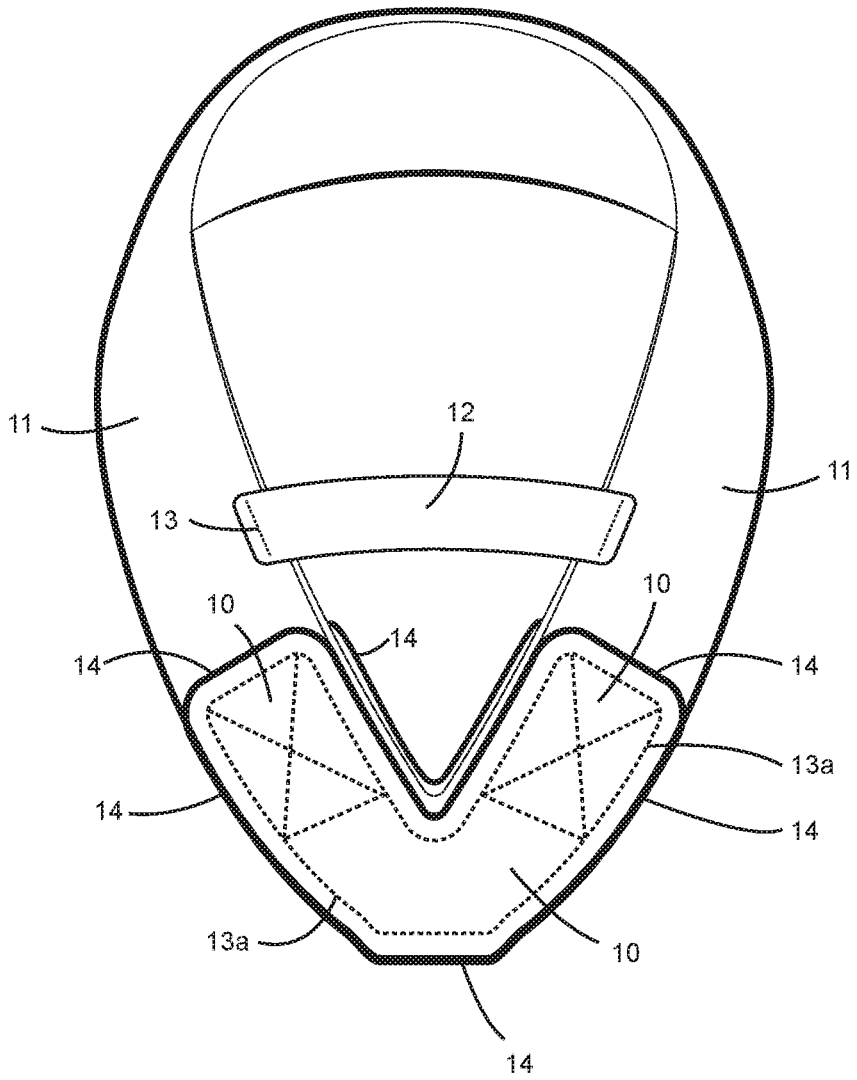
FIG. 1 is a top view of handgrip sport strap.

10 "V" area made up of 10*a*, 11, 13 and 13*a* after assembled
10*a* Non-slip material
11 Strap material
12 Braided elastic material
13 Stitching using thread by sewing machine on strap material 11
13*a* Stitching using thread by sewing machine on strap material 10*a*
14 Edges of 10*a*
15 Cut line using a cutting tool after sewing 13
50 Equipment or handle of object being used
51 Human hand

DETAILED DESCRIPTION OF THE INVENTION

Referring to FIG. 1, a top view of hand grip sport strap showing the symmetry of invention. There is no left or right hand strap. The only difference between a small, medium, large, x-large and xx-large size hand grip sport strap is the length of the strap material 11. Referring to all sizes, all parts that make up the "V" area 10 and 12 are placed and sewn exactly the same. There is no difference in the "V" area 10 and 12 after sewing. All parts that are sewn in the "V" area 10 with 12 are sewn in the exact location on all sizes. The only difference from one size to another is the length of strap material 11.

Figure 7:
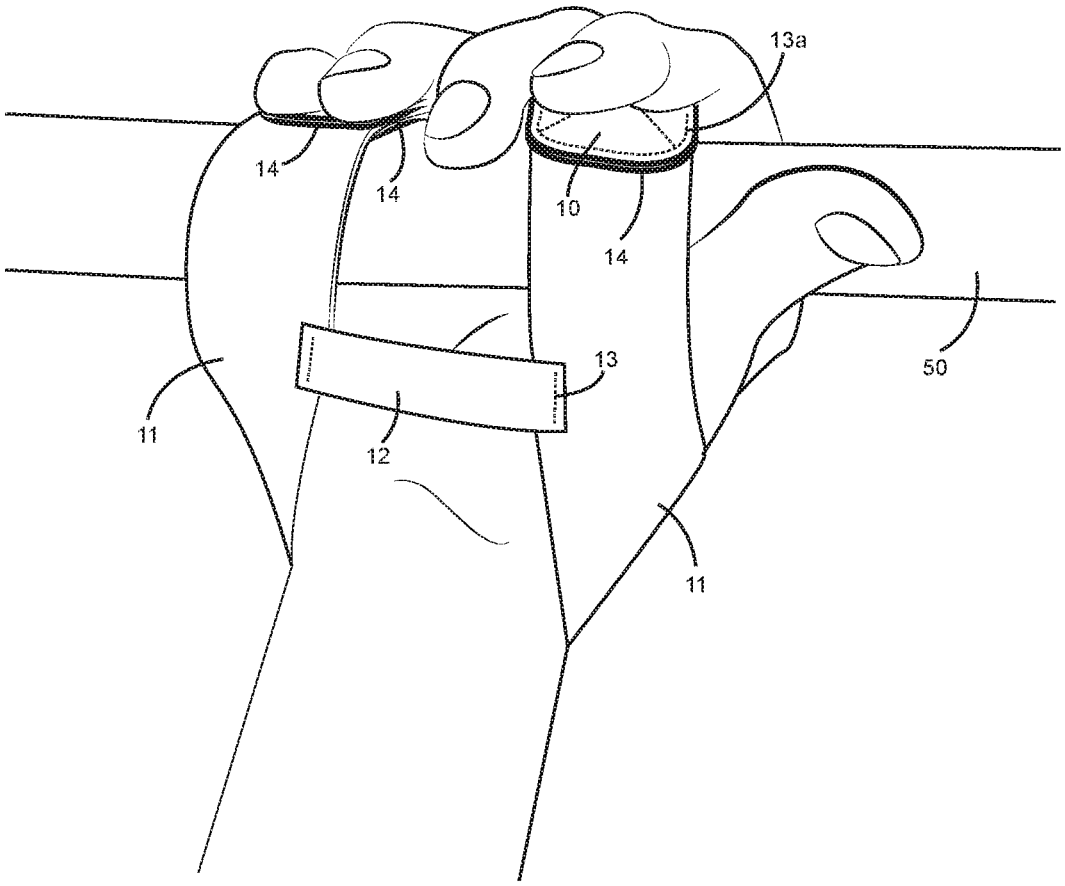
FIG. 7 is showing all four fingers touching and adjusting the "V" area.
Figure 11:
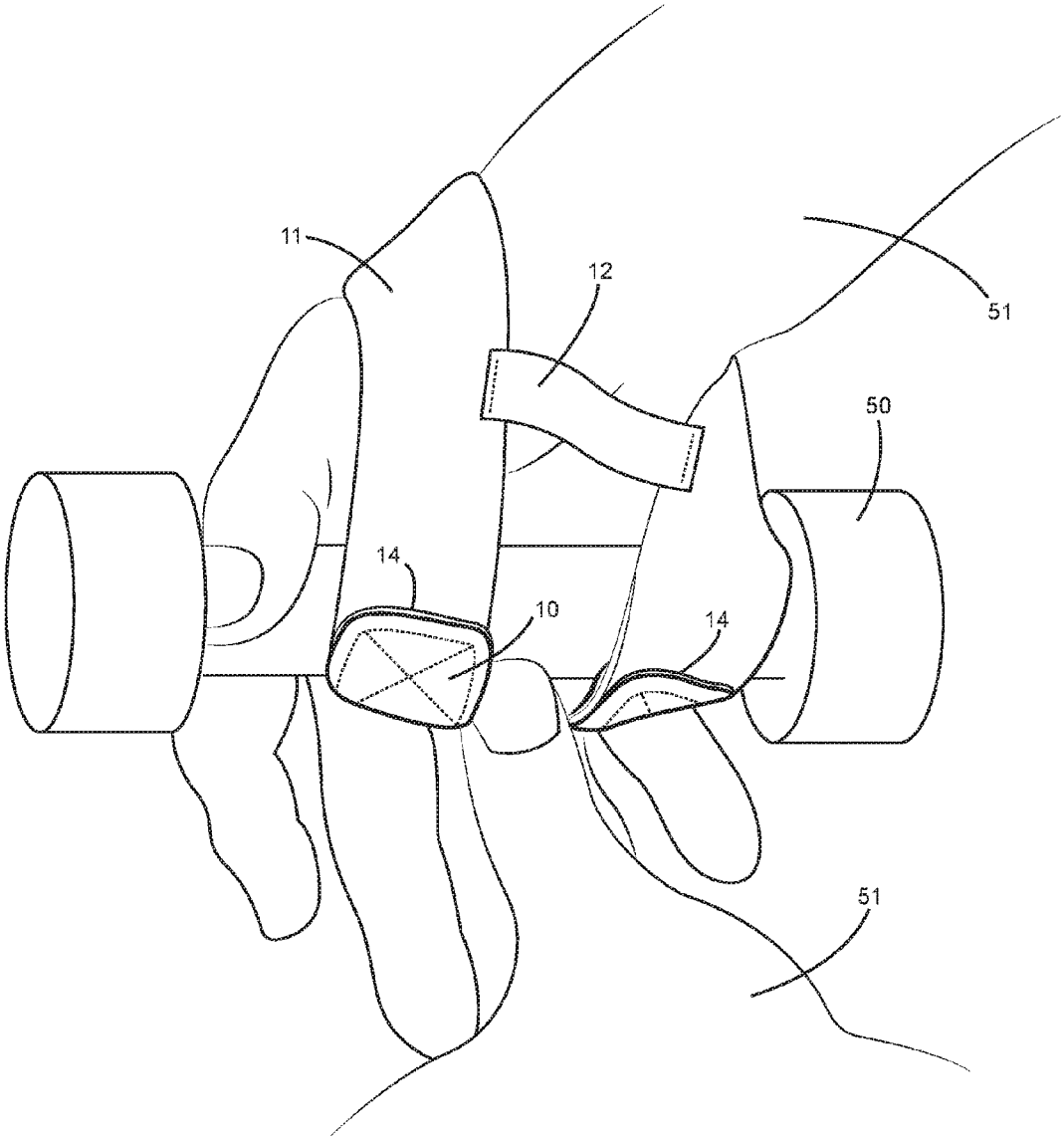
FIG. 11 is showing the thumb of the users other hand pushing the "V" area around the gripping area of a dumbbell bar piece of equipment.
Figure 12:
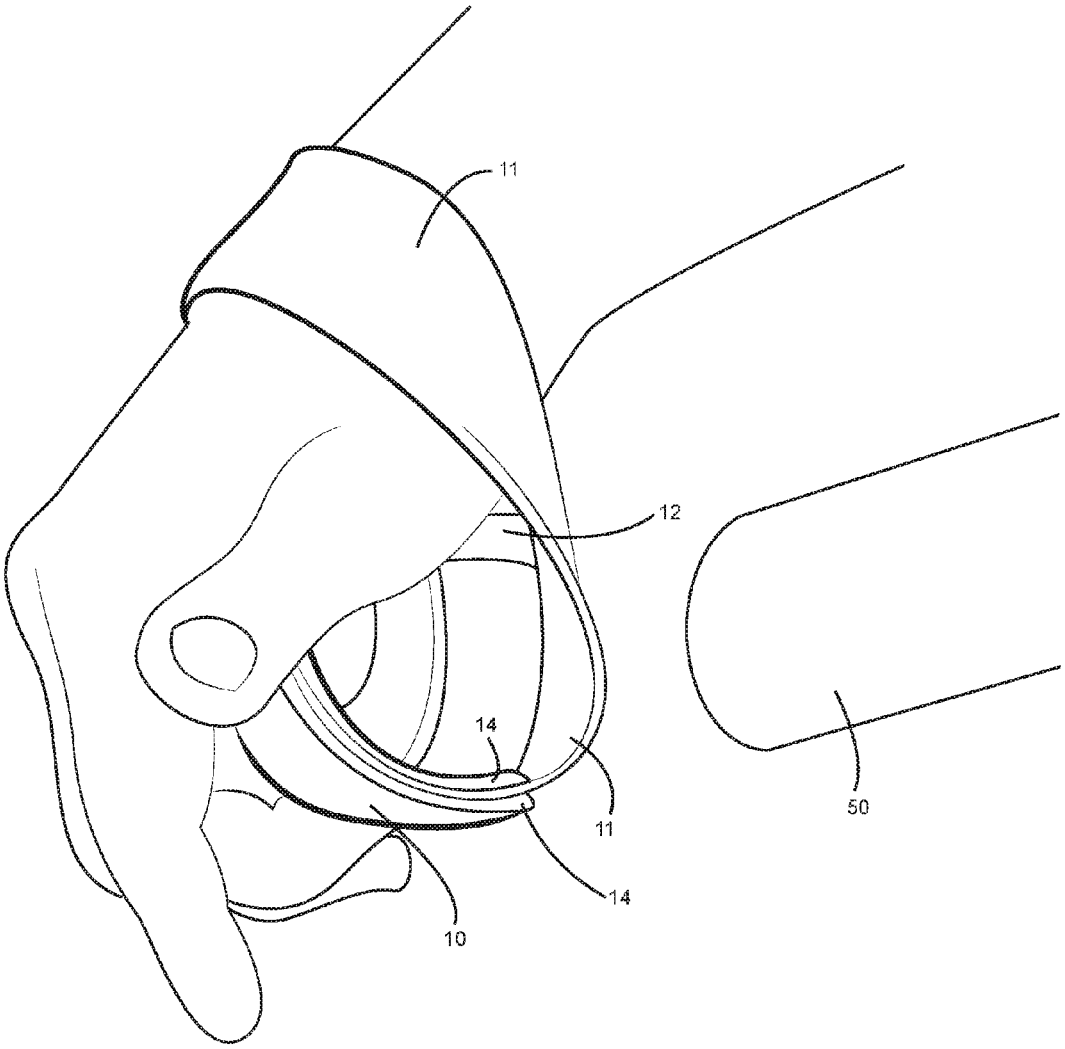
FIG. 12 is showing the user curling the "V" area with the middle finger and getting it ready to slide it over the end of a bar or handle of a piece of weight lifting equipment.

The "V" area 10 made up of 10*a*, a non-slip material, 11 strap material, 13 stitching using thread by sewing machine on strap on 11 strap material and 13*a* stitching using thread by sewing machine on 10*a* is the heart and key to this invention. 14 the edges of 10*a* provide touching, grabbing and adjustment areas for the fingers of the hand using this hand grip sport strap. The "V" area 10 is designed to be adjustable with the fingertips of the hand using 14 edges of 10*a* non-slip material. This can be best seen in FIGS. 7, 11 and 12.

Figure 2:
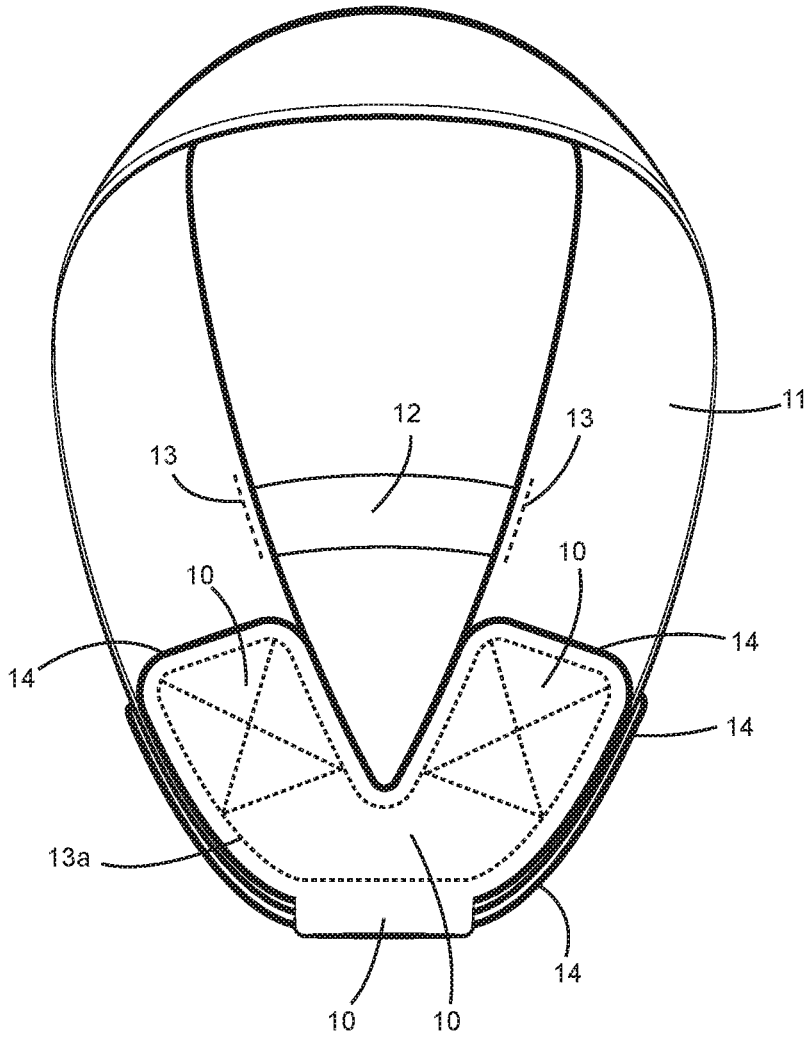
FIG. 2 is an inside bottom view of hand grip sport strap.

FIG. 2 showing inside bottom view of the hand grip sport strap looks the same as FIG. 1 except for 12 braided elastic placement and 13 stitching. You have the same 14 edges on the inside that will help in the gripping and adjustment of the invention as needed for tightness, looseness and overall comfort and control.

Figure 3:
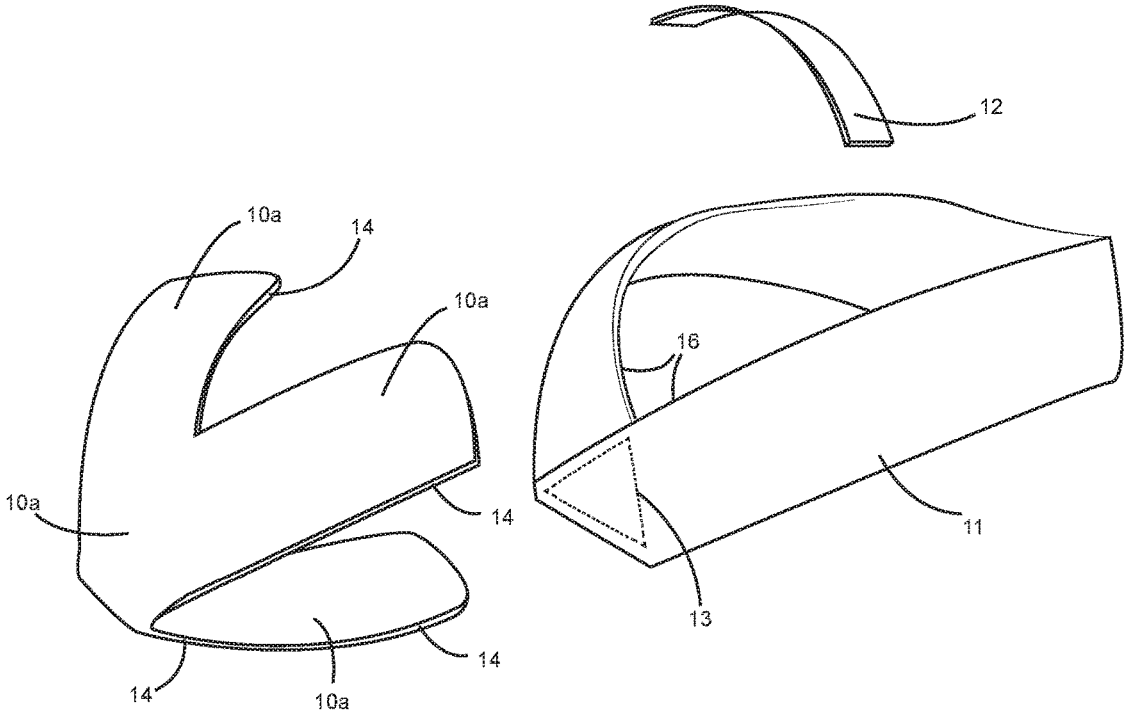
FIG. 3 is an exploded view showing the parts separated but in correct relationship to each other with the strap material being overlapped and sewn together with the strap material and the strap material at the tip of that. Sewing has been removed.
Figure 5:
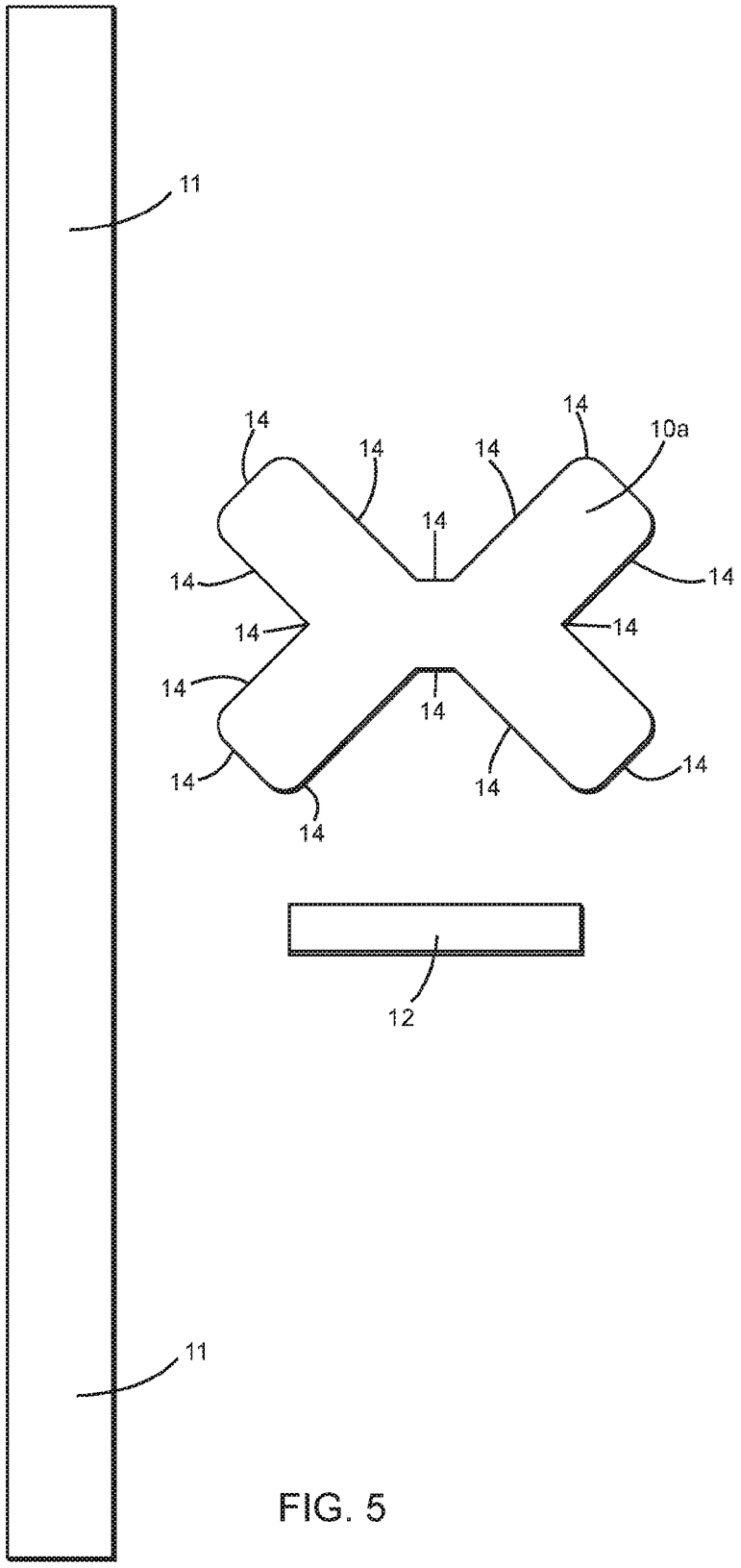
FIG. 5. is all the three parts that make-up the hand grip sport strap before being sewn together.
Figure 6:
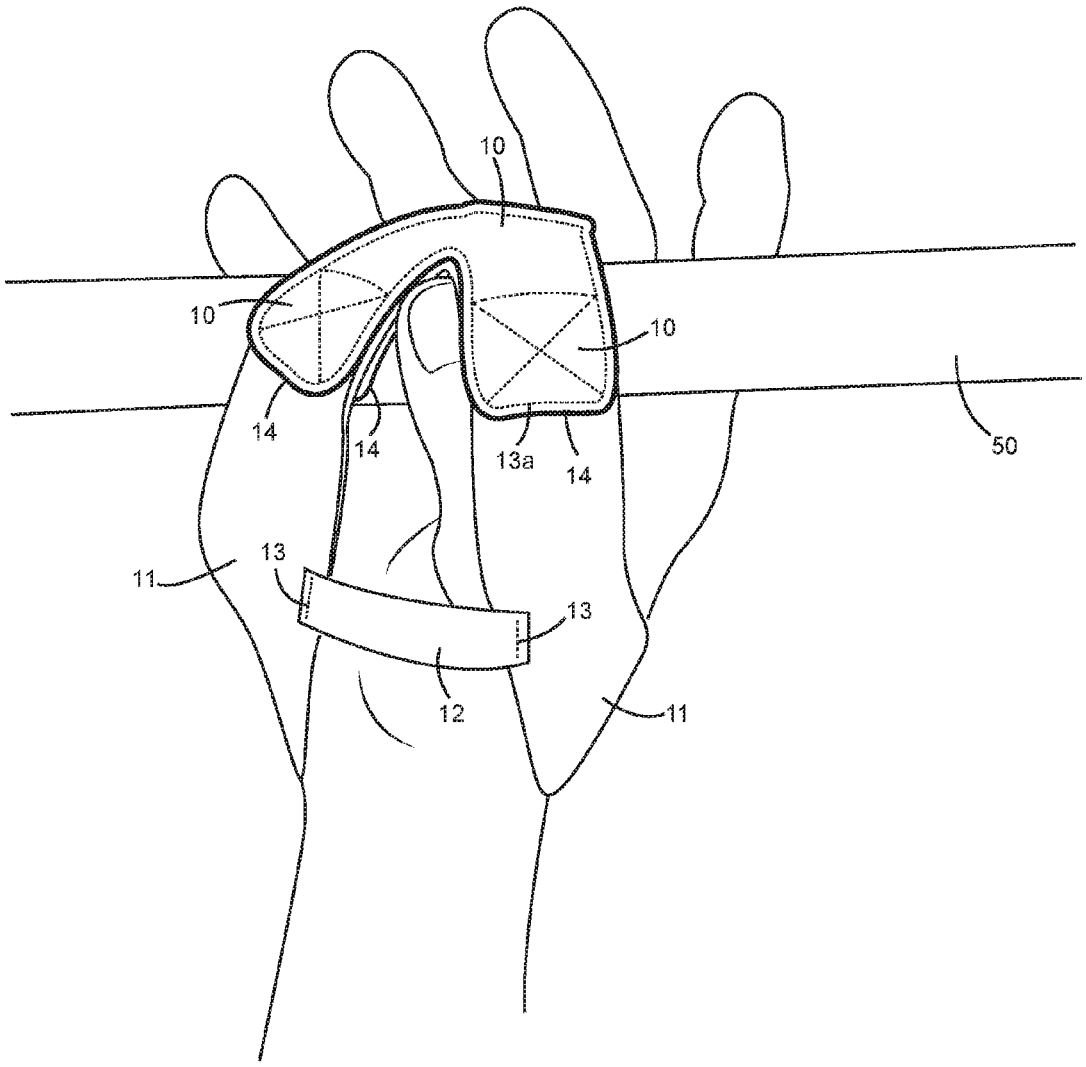
FIG. 6. is showing the tip of the thumb of either hand and placing the tip of the thumb into the "V" area to support the "V" area while placing the "V" area on to and around the object being grabbed.

As can be seen in FIG. 3 and FIG. 5 this hand grip sport strap is only made-up of three parts 10*a*, 11 and 12 along with 13 and 13*a* stitching.

Figure 4:
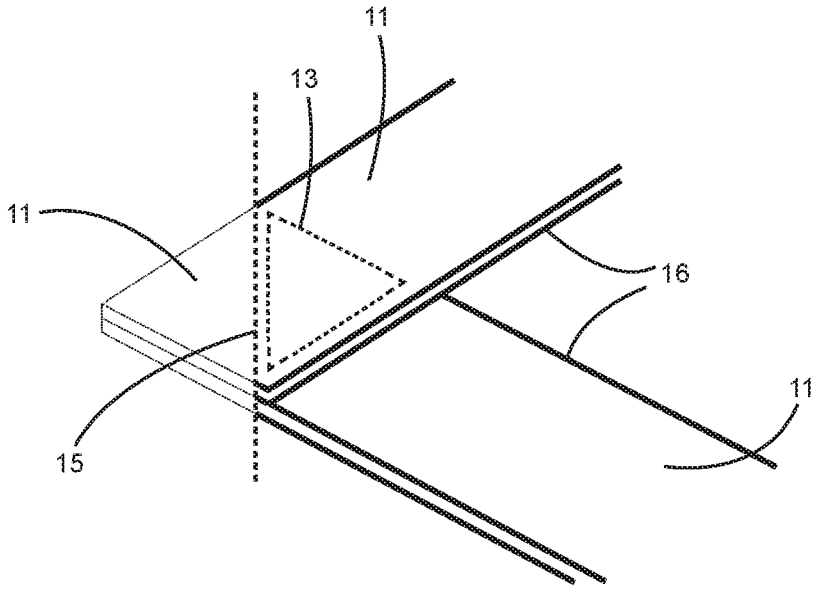
FIG. 4 is the strap material sewn together with a cut line where the tip of that sewing will be removed before non-slip material added and sewn.
Figure 8:
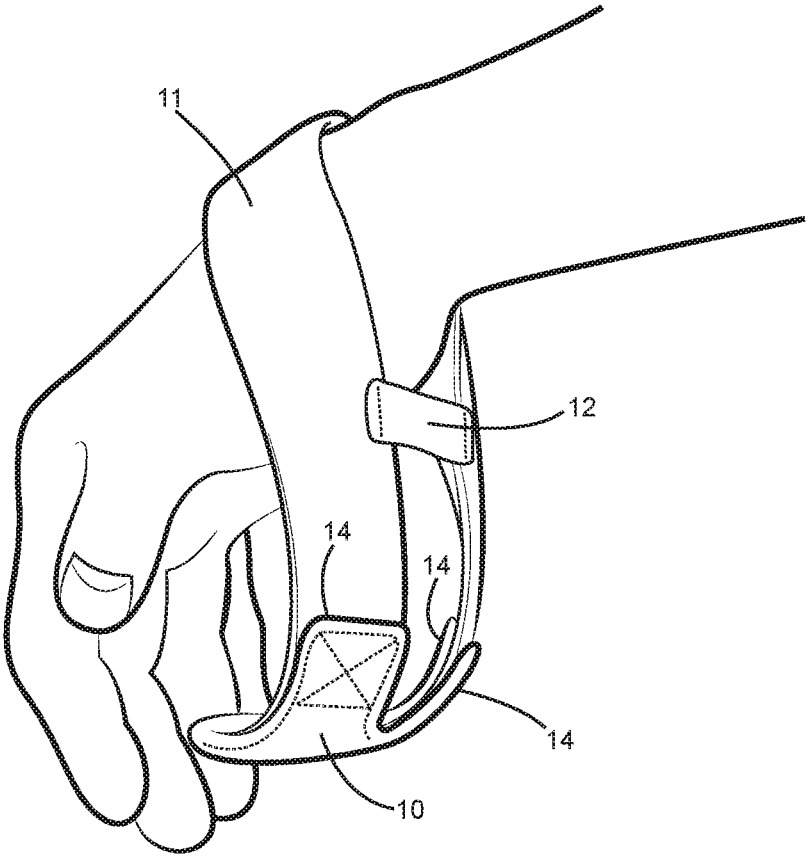
FIG. 8 is showing the hand pointing down with the hand grip sport strap on the back of the hand and also showing the "V" area and its natural curve, after assembly, ready to grab any bar or handle.
Figure 9:
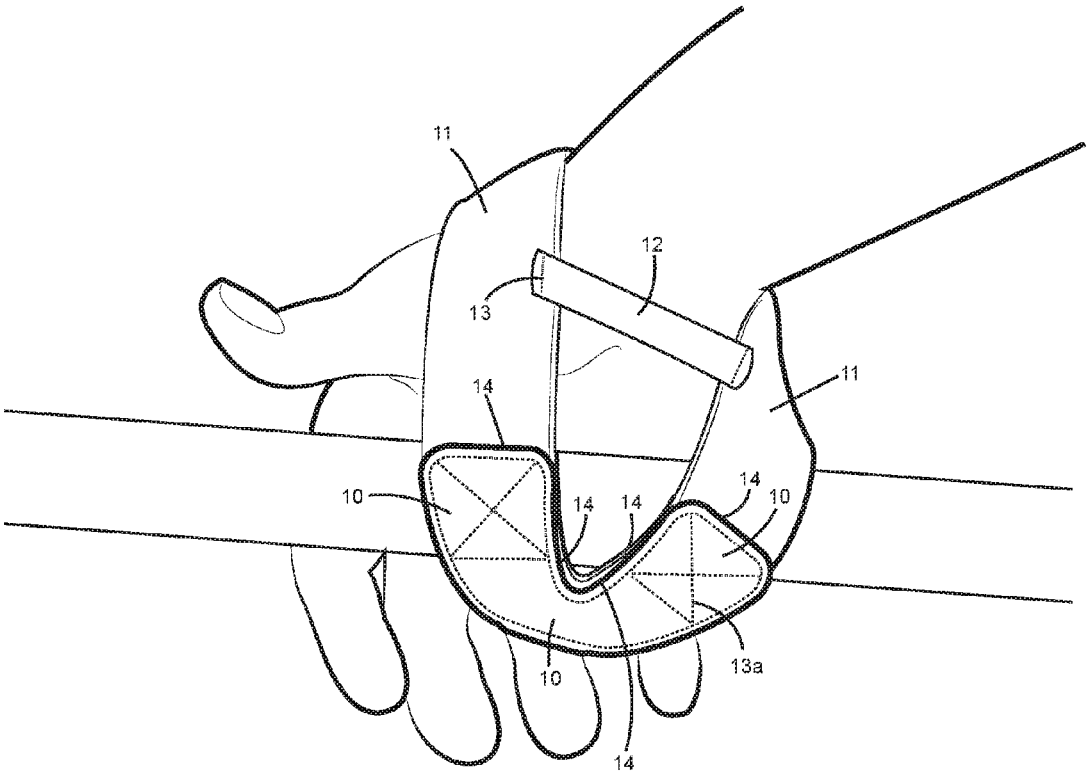
FIG. 9 is showing the hand pointing down with the hand grip sport strap on the back of the hand and showing the "V" area being grabbed but not adjusted.
Figure 10:
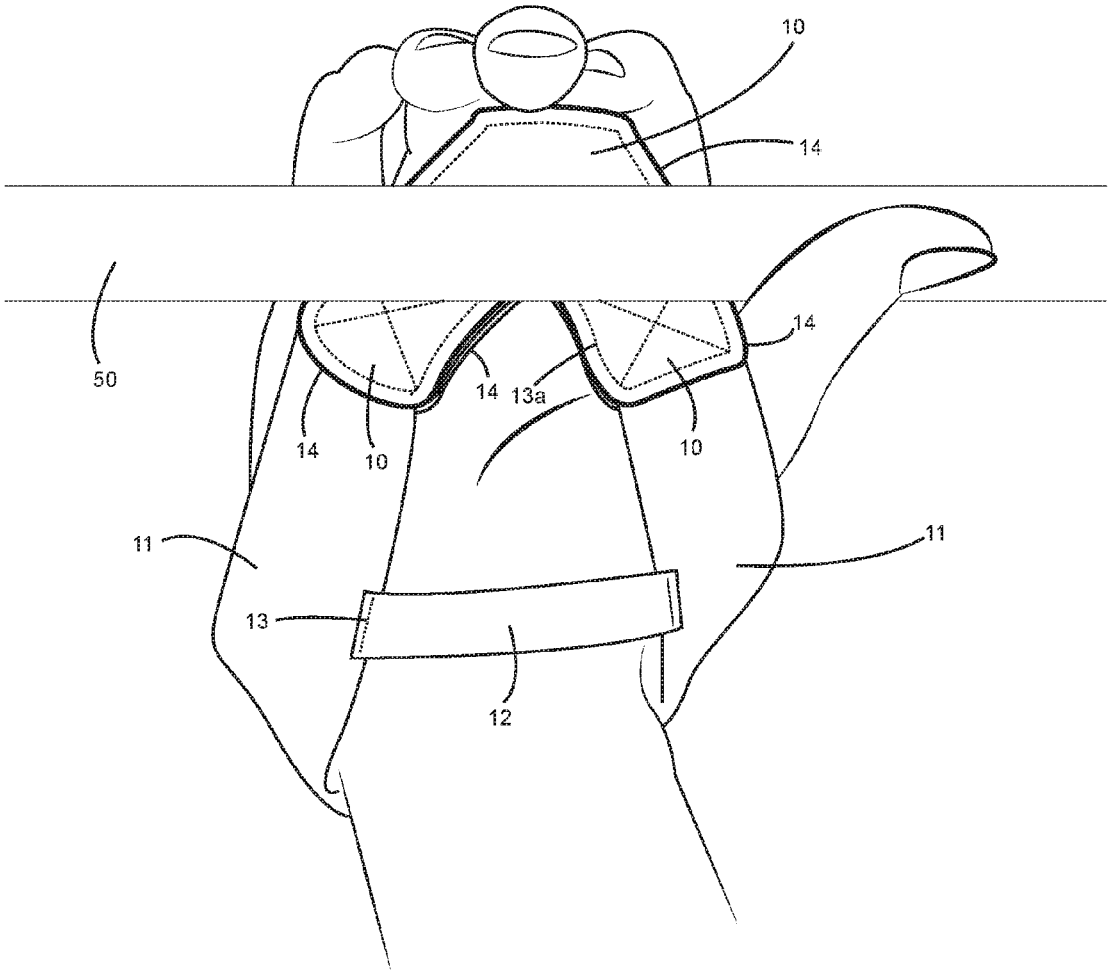
FIG. 10 is showing the "V" area laid in and against the palm of the fingers of the hand.

FIG. 4 shows the 11 strap material being sewn together and then the tip of two layers of 11 strap material being removed and cut off at 15 cut line with cutting tool. This is a very important step in the manufacturing of this hand grip sport strap for a number of reasons. Once the two ends of 11 strap material are sewn together it will provide a natural curve in the "V" area 10 as seen in FIG. 8. If the material at 15 cut line with cutting tool was not removed it would provide a pressure point on the inside of the hand or palm area of the user. This could cause some discomfort for the user. Also by removing this material at 15 cut line with cutting tool will allow the user to make adjustments of the "V" area 10 as seen in FIGS. 6, 7, 10, 11 and 12. This will allow the user to push and place the "V" area 10 in the proper location.

It also must be mentioned that the only reason 12 braided elastic is used is to stop the hand grip sport strap from falling off the hand of the user when not in use. 12 braided elastic, is part of the "V" area 10. The placement of 12 braided elastic is placed and sewn in the same location on all sizes whether that size be the small or xx-large. The only difference in all sizes of the hand grip sport strap is the length of 11 strap material.

What is claimed is:

1. A handgrip sport strap for weight lifting or any other activity that will help to control, support and improve the users' grip during the exercise or activity comprising of one piece of a single layer strap material having a first and a second end;

each end being defined by a front edge, an inner edge, and an outer edge, wherein the front edge extends at an acute angle to the inner edge;

the front edge of the first end is aligned with the front edge of the second end such that the inner edges of each end meet and the first and second ends overlap to form a loop and define a V area at the overlap of the first and second ends;

the loop having an inside surface area and an outside surface area with only the inside surface area configured to come in contact with a back of a user's hand plus or minus 180 degrees between the metacarpal joint and the knuckle of the hand;

a grip portion comprising a high wear, non-slip material with an inside and outside surface, said inside surface being attached to the overlapped ends to cover the inside and outside surfaces of the at least the V area; and one piece of braided elastic material with two ends attached to the strap material across the inner edges.

2. A hand grip sport strap of claim 1 there is no additional cushioning required, only the one layer of strap material that comes in contact with the back of the hand plus or minus 180° between the metacarpal joint and the knuckle of the hand.

3. A hand grip sport strap of claim 1 when the V area is only used for adjustment of said V area with said edges of the strap material and the high wear, non-slip material after attachment with stiching.

4. A hand grip sport strap of claim 1 in use the V area on both the inside and outside surfaces is configured to use the compressions of the inside of the palm of the hand, fingers and the object being used to hold and maintain the contact and adjusted as needed; therefore there is no need for any other locking features other than compression of the hand, fingers and the object being used.

5. A hand grip sport strap of claim 1 after forming the V area with the first end and second end being overlapped forming a perpendicular right angle and secured, a tip made with two layers of strap material is cut off prior to the attachment to create an edge vs a tip, that will make the edge area easier to adjust after non-slip material is added and because the tip, if not removed makes a pressure point in the palm of the hand of the user that can be irritating to that user when in use.

6. A hand grip sport strap of claim 1 the braided elastic material with two ends with one end attached to one outside surface of strap material and the other end attached to the other outside surface after the loop of strap material is formed;

the braided elastic is used to help stop the strap when not in use, from falling off the hand of the user when not in use but still allowing the hand grip sport strap to fit very loosely around the user's wrist at all times.

* * * * *